United States Patent [19]

Wiesner

[11] 4,219,134

[45] Aug. 26, 1980

[54] METERING-DISTRIBUTORS FOR BOTTLED THICK LIQUIDS FOR THE PREPARATION OF BEVERAGES

[76] Inventor: Alfredo Wiesner, Via Oldoardo Beccari, 23, Roma, Italy, 00100

[21] Appl. No.: 857,444

[22] Filed: Dec. 5, 1977

[51] Int. Cl.[2] ..... B67D 5/56

[52] U.S. Cl. ..... 222/129.3; 222/133; 366/165; 366/174

[58] Field of Search ..... 222/129.1–129.4, 222/133, 145; 366/165, 167, 174

[56] References Cited

U.S. PATENT DOCUMENTS 3,643,688 2/1972 Meinert ..... 222/129.2 X

*Primary Examiner*—F. J. Bartuska

*Attorney, Agent, or Firm*—Staas & Halsey

[57] ABSTRACT

An improved metering-distributor of a mixture of water and syrup comprising apparatus to support a bottle in overturned position, a vertical conduit arranged in the support apparatus for putting in communication the bottle and a metering-cup mounted below the conduit, a main valve slidably mounted inside the metering-cup and having a lower limit position in which syrup falls down in the metering cup and the delivery conduit entrance is closed and a second upper limit position in which the syrup from the metering-cup passes into the syrup delivery conduit, and at the same time chilled water is delivered into the syrup delivery conduit, the metering distributor being provided with a composite disassemblable device, removably applied at the lower end of the syrup delivery conduit and so shaped to form two vertically superposed chambers communicating to one another by a central hole, in the upper one of which enters only the syrup, while in the lower chamber, which entends downwardly with a vertical mixture outflow conduit, water is supplied through a screened entrance orifice, in order to prevent the water entering the superposed upper chamber.

5 Claims, 5 Drawing Figures

METERING-DISTRIBUTORS FOR BOTTLED THICK LIQUIDS FOR THE PREPARATION OF BEVERAGES

BACKGROUND OF THE INVENTION

1. Field of the Invention

The present invention concerns improvements in the metering-distributors of bottled thick liquids, in particular syrups, for the preparation of beverages or the like, together with a quantity of cold water, the metering-distributors being designed to be used for the extemporaneous preparation of the beverages consisting of a mixture of water and syrup or the like.

2. Description of the Prior Art

The known metering-distributors are each designed to receive respectively a syrup container or the like, in particular a bottle, mounted on the metering-distributor in overturned position, each metering-distributor comprising a support member provided to put the bottle mounted thereon through which a vertical conduit is arranged, in communication with a metering cup placed therebelow and provided with an air intake from the atmosphere. In this reciprocating metering cup a main valve performs two functions, said main valve being made integral with a delivery conduit and with a manually actuated control cross bar, said valve being maintained in a first operative position or rest position by a first spring whereby the main valve enables said metering cup and the bottle to freely communicate with one another and at the same time closes the communication between the metering cup and the fluid delivery conduit, while, when one moves upwards said cross control bar upward against the bias of the return spring, the valve prevents any communication between the metering-cup and the bottle and opens the communication between the metering-cup and the delivery conduit so as to allow a metered quantity of syrup to be dispensed.

The movement of the cross member, which is carried out by the user, causes a second valve to open which controls the pipe orifice through which cold water is conveyed, the orifice opening into the delivery conduit of the syrup so as to feed therein the water necessary to form the mixture constituting the beverage.

These types of metering-distributors of alcoholic and nonalcoholic beverages present an inconvenience which is very important from a hygienic standpoint, i.e. it frequently occurs that on the lower portion of the delivery conduit, positioned below the zone where the water is introduced and the mixture of the water and syrup is formed, a liquid film remains adherent to the inner surface of the conduit, the film consisting of an aqueous syrup solution. It is well known that a syrup can be kept in good condition a long time, owing to its high sugar content; on the contrary, if a syrup has been diluted with water, it is susceptible to rapid deterioration, as well as to ferment and altering and it can also attract insects, dangerous bacteria and the like, since in these known distributors no separation is provided between the syrup and the aqueous solution obtained thereby.

SUMMARY OF THE INVENTION

The present invention proposes to modify the device designed to convey the water for obtaining the mixture thereof with the syrup, by mounting below the lower end of the syrup delivery conduit a composite cup-like device constructed and shaped in a particular manner so as to maintain the two components of the mixture separated from one another, up to the formation of the mixture thereof, the device being formed in combination by two parts which are disassemblably connected to one another and which can be removed from the distributor without the use of any tool so as to allow their disassembly and separation for a perfect and easy cleaning thereof, in order to remove the film of diluted sugar solution which can have been deposited thereon. This improvement can be therefore universally applied to all the known types of metering-distributors with a few simple adaptions.

According to a variant of this invention, provision has been made to apply the auxiliary cup-like composite device to the conduit dispensing the metered quantity of syrup and water in such a manner that by performing a movement in the opposite direction with respect of the conventional movement by means of which commonly the syrup and water are dispensed, it is possible to obtain the delivery of solely water, when it is desired to deliver water only, or in the event that a water delivery is required in order to perform, at time intervals, a temporary washing of the device without entirely disassembling this latter, while the disassembly and cleaning can be carried out in a more complete and perfect manner at more spaced time intervals.

These and other characteristics of this invention will be better understood from the following description of an embodiment thereof, taking in consideration the accompanying drawings, in which:

DESCRIPTION OF THE PREFERRED EMBODIMENT(S)

Figure 1:
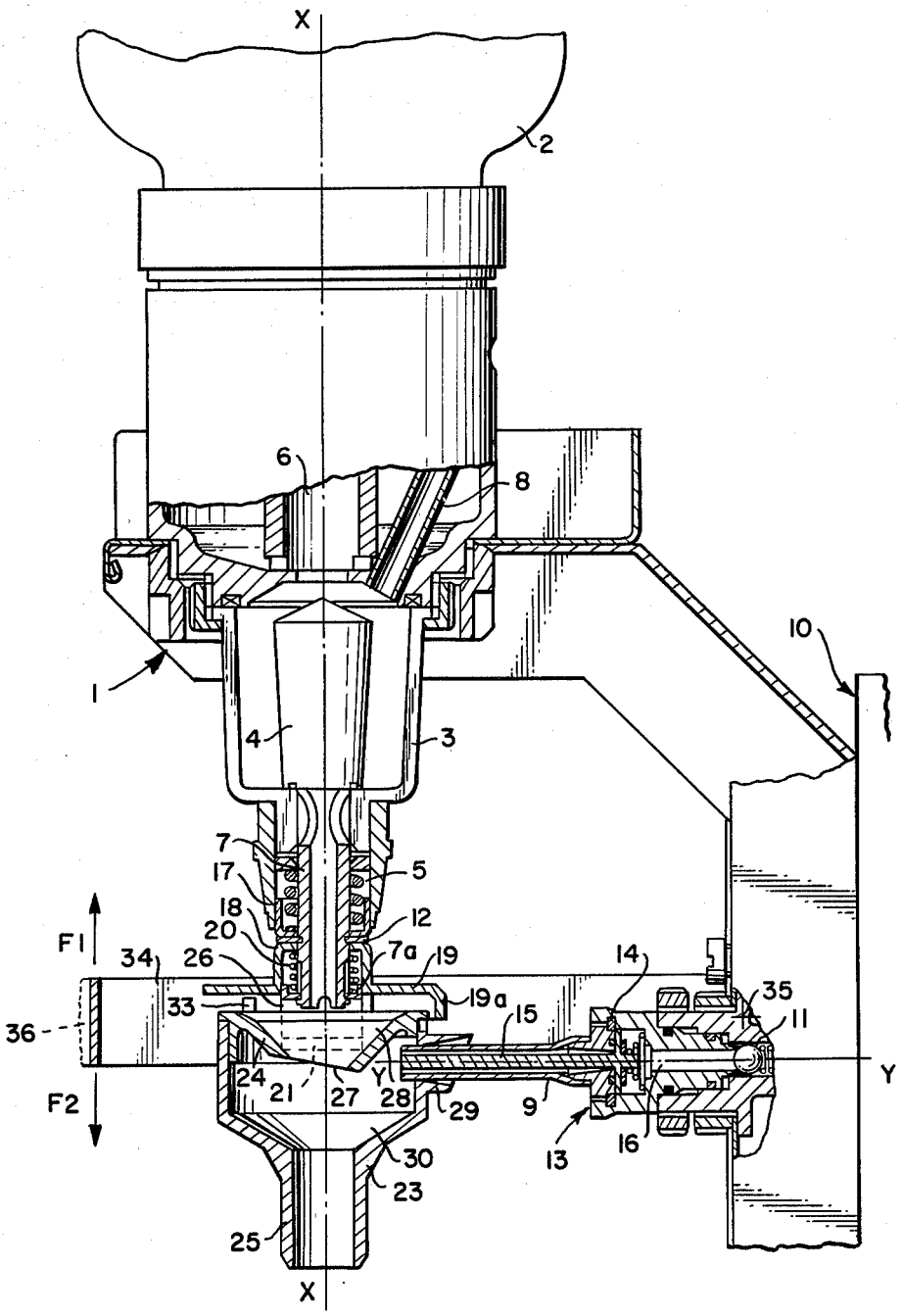
FIG. 1 is a partial side view of a metering-distributor, in which the lower part thereof, which has been modified by the present invention, is shown in a section taken on the plane passing through the vertical axis X—X of the distributor and through the axis Y—Y of the water supply conduit in rest position of its operative structure.

At 1 is generally indicated a volumetric metering-distributor of a "per se" well known type designed to support a container, in particular a bottle 2, in overturned position. Only the lower portion of said metering-distributor will be described in detail, and which comprises a metering-cup 3 housing a main valve 4 performing two functions. In fact, as is well known, the valve 4 is normally held by a spring 5 in a rest position in which it closes the communication between the metering-chamber and the delivery conduit 7 of the syrup coming from the bottle 2, while when the user moves this valve 4 upward in the direction of the arrow $f_1$ acting against the action of the return spring 5, the valve closes the outlet orifice of the conduit 6 and opens the communication between the metering-chamber and the delivery conduit 7 which is made integral with the body of the valve 4. At the same time through a small pipe 8 in communication with an air intake from the outside atmosphere air is sucked from the atmosphere into the metering-cup 3 in an amount sufficient to allow the metering cup 3 to be emptied of the metered amount of syrup, the air taking the place of the syrup volume which flows out from distributor 1, which air, rising along the conduit 6 into the bottle 2, passing through the syrup mass contained therein so that as the valve 4 is returned to its rest position, an identical volume of syrup from bottle 2 can enter metering-cup 3.

This part of the distributor 1 is quite conventional so that no further details will be given.

Figure 2:
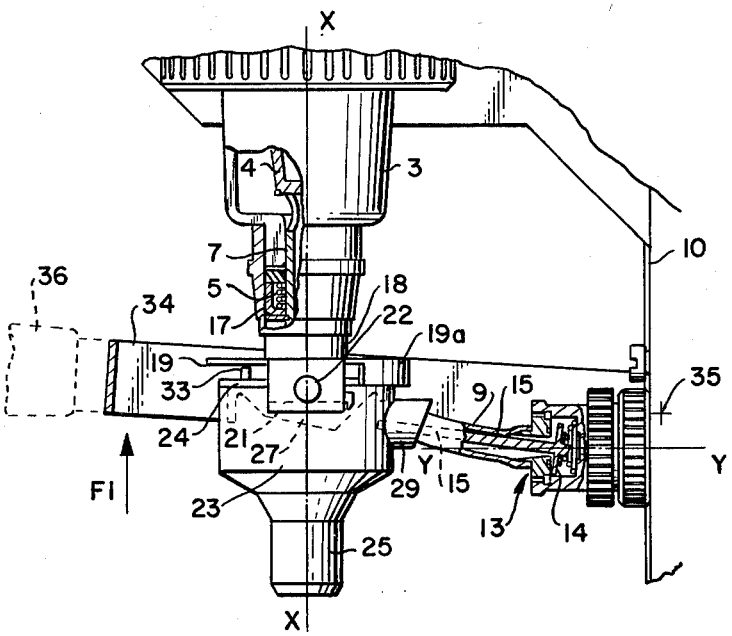
FIG. 2 is the detail of the lower part of the distributor together with the cup-like composite device, shown partly in a side view and partly in section, in the position of its operative structure when the mixture is being formed.
Figure 3:
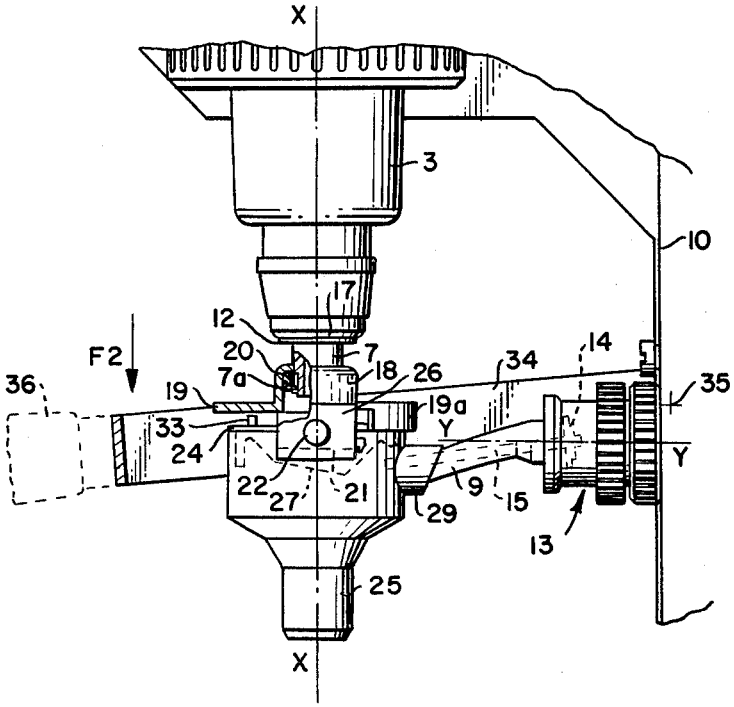
FIG. 3 is a view, similar to that of FIG. 2, but in the position of the cup-like device, provided for the delivery of water only.

At 9 is indicated a pipe which is at least partially flexible and which is designed to convey chilled water, pipe 9 being connected to a pipe (not shown in the drawings) designed to supply chilled water which is produced in any suitable refrigerator. In the pipe 9 is mounted a set of valves including a check valve 11, housed inside a valve body fixed on a support wall 10 and which is designed to automatically prevent any water flow, if the removable valve body 13 of a disc valve 14 is disassembled, the disc valve 14 being integral with a control valve rod 15 which is coaxial with the pipe 9 when in rest position of this latter, and which serves to permit a water delivery at the same moment in which the metered quantity of syrup is dispensed by the metering-distributor 1. The valve rod 15 can be swung as a result of any vertical displacement of the flexible conduit 9 and therefore of the valve 4, so as to cause the disc valve 14 integral with rod 15 to be inclined to one side with regard to its valve seat so as to define a side passage between valve 14 and its valve seat so as to permit water to pass therethrough, which has to be mixed with the syrup (FIGS. 2 and 3). As the valve body 13 of the valve 14 has been mounted, tube 16 extending rearwardly and facing said valve 14 will be pushed back so as to maintain the check valve 11 in its open position against the bias of a spring.

According to this invention the syrup delivery conduit 7 extends beyond a cup-like flange 17 or the like, made integral with conduit 7 and which serves to support the spring 5, the cup-like flange in the conventional metering-distributors being made integral with a control cross bar, which is manually actuated.

Figure 4:
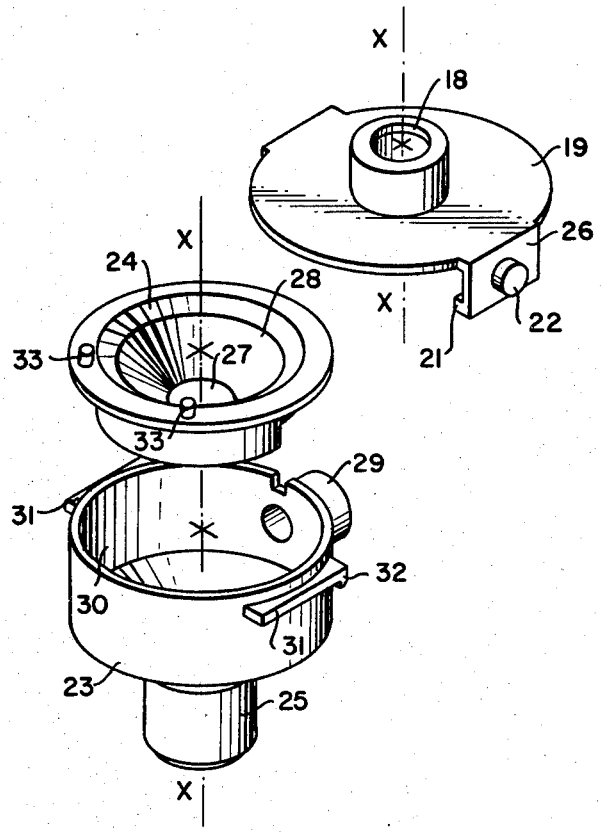
FIG. 4 is an exploded view of the cup-like composite device so as to better understand the structure of the components thereof.
Figure 5:
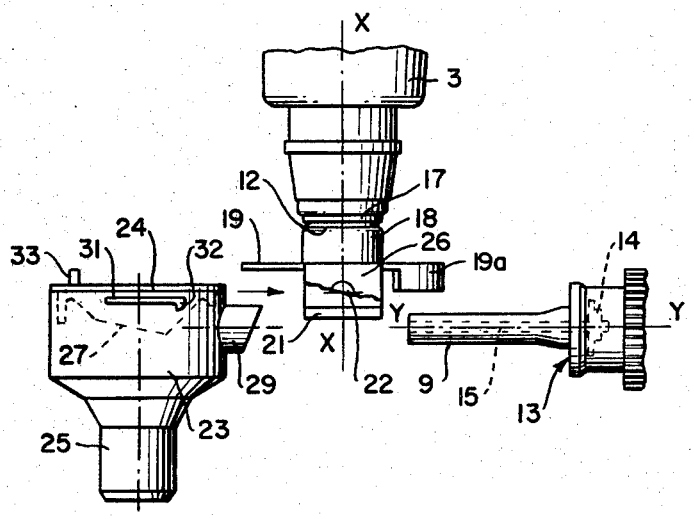
FIG. 5 shows the side view of the cup-like composite device in its disassembled position, the view being taken from a plane parallel to the axes X—X and Y—Y.

According to this invention the lower end portion of the conduit 7 extending downwardly beyond the cup-like flange 17 ends with an outwardly extending flange 7*a* or the like, on which is slidably mounted a cap 18 which at its lower part enlarges outwardly and forms a cover-like element 19 depending from flange 7*a* with the interposition of an expansion helical spring 20 which is housed inside cap 18 and upon the flange 7*a*, and which tends to press cover element 18, 19 against the cup-like flange 17 which is prevented from being raised by the presence of a washer 12 fixed about the body of the conduit 7. The cover element 19 is provided with a partial peripheral edge 19*a* bent downwardly only in that portion of its periphery that in the assembled position of the device will face the water supply pipe 9, while on both sides two opposite lugs 26 depend from the cover element 19, which are parallel to the axis X—X of the distributor 1 and to the axis Y—Y of the water supply pipe 9. On the inner surface of each of lugs 26 is provided an inwardly projecting horizontal shoulder 21, shoulders 21 forming in combination support guiding-rails, while from their outer surfaces extend outwardly two coaxial small pins 22. The cover element 19 forms together with a removable lower element, formed in two parts 23, 24 releasably connected to one another, a cup for the mixing of the water and syrup with one another. The lower part 23 of the cup element is constituted of a hollow cylindrical body radiused by a conical bottom with a delivery conduit 25, the body 23 being designed to be connected, in a disassemblable manner, to the part 24, constituted of a frusto-conical cross wall having an elliptic central hole 27, the cross area of which is substantially identical to that of the delivery orifice of the conduit 7 and which is obtained cutting the conical wall 24 along a plane forming an angle with respect to the axis X—X slightly smaller than 90°. The frusto-conical wall 24 defines together with the cover element 19 (which remains always joined to the distributor 1) a frusto-conical chamber 28, to receive the syrup, while the hole 27 at the center of the wall 24 has its edge inclined towards the entrance orifice of the radial pipe union 29, through which the pipe 9 enters the mixing chamber 30 placed below the chamber 28 and defined between the wall 24 and the cup element 23 so that the lowermost portion of the edge of the hole 27 acts as a baffle screen so as to prevent water splashes from entering the upper chamber 28, the inner surfaces of which can be only covered by syrup drops. At the outer sides of the cup element 23, at diametrally opposite positions and at right angles to the axis of the radial pipe union 29, outwardly extending limbs 31 are provided (FIGS. 4 and 5) which are horizontal and rectilinear, each ending at its rear end with a tooth 32 extending downwardly, while from the front portion of the upper edge of the element 24 at least two teeth 33 extend upwardly.

By slightly inclining the cup-like element 23, 24 from the front towards the upper part, the teeth 33 can be brought over the front edge of the cover element 19 (FIG. 5); thus it will be possible to push the teeth 32 together with the limbs 31 to raise on and slide along the guiding shoulders 21, while, at the same time, the front portion of the cup element 23 is caused to be inclined towards its horizontal position to bring each tooth 32 at the end of the respective shoulder 21 to be hooked to the end of each shoulder 21 so that the limbs 32 can securely rest on the upper surfaces of shoulders 21, giving to the cup element 23 together with the wall 24 received therein a horizontal position, so that the teeth 33 owing to a slight gap can also be introduced, below the front portion of the cover 19 thus acting as spacing means. In this way the cup device 19, 23, 24 remains suspended from the distributor 1 with safety in a perfectly stable and horizontal position, while at the back the edge 19*a* extending downwardly rests substantially on the pipe union 29, in the inside of which the end of the water supply pipe 9 has been contemporaneously introduced together with the control rod 15 housed therein. The diametrally opposite pins 22 extending outwardly from the lugs 26 are designed to be received into longitudinally elongated slots (not shown), arranged in a control arm shaped as a slightly deformable fork member pivotally connected at 35 to the wall 10, at a point near the zone where the valve assembly 13, 14 is mounted, the arm 34 ending at its outer portion with a control handle 36, which is only partially shown.

During a normal operation of the metering-distributor 1, it is sufficient to raise the control arm 34, which owing to the pin connection 22 and the pin guiding slots causes the cover element 19 to be lifted together with the cup element 23 suspended therefrom and connected in a disassemblable manner; thus performing the raising of the whole assembly supported by the main valve 4 in the direction of the arrow $f_1$, the valve 4 (FIG. 2) enables the metering-cup 3 to be emptied as a result of the upward movement of the cap 18 together with the cover element 19 and the cup element 23, 24, in contrast with the action of the spring 5.

At the same time movement of valve 4 causes an upward deflection of the flexible pipe 9 and as a result thereof, the inclination of the rod 15 with respect to the axis Y—Y of the valve seat 13 of the disc valve 14 so that valve 14 will be inclined, causing a water side passage to be formed between disc valve 14 and its seat 13, while through the delivery orifice of the conduit 7 the predetermined metered amount of syrup falls down from the chamber 28 into the chamber 30 passing through the hole 27. In lower chamber 30 a water-syrup mixture is obtained which is delivered through the conduit 25 which remains (as does the cup element 23) always in a substantially vertical position.

After releasing the gripping on the handle 36 of the control arm 34, the parts automatically are returned to their starting positions under the return effect of the spring 5 and owing to their weight. In the event that it is desired to deliver only cold water, as for instance, for cleaning purpose, in order to wash the lower mixing chamber 30, in which residuals of the diluted solution of the syrup are susceptible to deterioration, fermentation or the like, it will be sufficient to press the control arm 36 downwardly in the direction of the arrow f2. In this manner the second spring 20 (FIG. 3) will be compressed and the lowering of the sole cup element 19, 23, 24 can be performed. As a result thereof, the pipe 9 will be accordingly inclined as well as the valve rod 15 controlling the opening of the disc valve 14, since the main valve 4 cannot be lowered, on account of the fact that it has attained its lower limit position. Therefore only water can be supplied into the chamber 30, water which can be used for the predetermined intended purposes.

What I claim is:

1. In metering-distributors having a mixture of syrup and chilled water, multiple apparatus for the preparation of beverages, each comprising a member to support a bottle in overturned position, wherein said support member includes a vertical conduit putting in communication said bottle and a metering-cup mounted below said conduit, a main valve slidably mounted inside said metering-cup and co-operating with a first return spring, having a lower limit position in which said valve puts the bottle in communication with said metering cup and closes the entrance to a syrup delivery conduit which is made integral with said main valve, while at a second upper limit position attained in contrast with the bias of said spring said valve closes the communication between the bottle and the metering-cup and opens the communication between said metering cup and the syrup delivery conduit, and which simultaneously opens at least partially a pipe flexibly connected with a source of chilled water with the interposition of a second valve, which includes means permitting said second valve to open at the same time as a metered quantity of syrup is delivered in order to form a water-syrup mixture the improvements consisting of a disassemblable removable device attached under the said syrup delivery conduit and so shaped as to form two vertically superposed communicating chambers the upper one forming a separation area and the lower one having a funnel-like cover for the syrup inlet, acting as mixing chamber, which extends downwardly with a vertical outflow conduit, and to which water is supplied through a screened orifice, in order to prevent water from entering the superposed, upper chamber, said device being actuated by means enabling to selectively supply into the mixing chamber syrup and water or water only.

2. In metering-distributors having a mixture of syrup and chilled water, multiple apparatus for the preparation of beverages, each comprising a member to support a bottle in overturned position, wherein said support member includes a vertical conduit putting in communication said bottle and a metering-cup mounted below said conduit, a main valve slidably mounted inside said metering-cup and co-operating with a first return spring, having a lower limit position in which said valve puts the bottle in communication with said metering cup and closes the entrance to a syrup delivery conduit which is made integral with said main valve, while at a second upper limit position attained in contrast with the bias of said spring said valve closes the communication between the bottle and the metering-cup and opens the communication between said metering cup and the syrup delivery conduit, and which simultaneously opens at least partially a pipe flexibly connected with a source of chilled water with the interposition of a second valve, which includes means permitting said second valve to open at the same time as a metered quantity of syrup is delivered in order to form a water-syrup mixture the improvements consisting of a composite disassemblable device, removably applied at the lower end of said syrup delivery conduit and so shaped to form two vertically superposed inner chambers communicating to one another by a central hole in the upper one of said inner chambers permitting only the syrup to enter, while in the lower chamber, which extends downwardly with a vertical outflow conduit, water is radially supplied through a screened entrance orifice, in order to prevent water from entering the superposed first chamber, wherein the lower portion of the syrup delivery conduit is provided with an annular outwardly extending flange on which is slidably suspended a cover, with the interposition of a helical spring therebetween to which is disassemblably connected, said composite device including a composite cup-like device consisting of two parts connected to one another in a disassemblable manner, the first part of said cup-like device comprising a cylindrical body having a frustroconical bottom wall extending downwardly with a water-syrup mixture delivery conduit and which is provided with a radially outwardly extending pipe union, into which the end portion of said flexibly connected water-supply pipe, can be removably introduced in which is housed a longitudinal valve rod integral with a disc valve controlling the delivery of the water and which can open only when the free end of the said water supply pipe will be laterally displaced, while a second part of said cup-like device consists of a frustoconical partition wall provided with a central hole, said second part being dissasemblably connected to the first part of said cup-like device, while the cover element has a central upwardly extending cap-like portion by means of which said cover element is suspended to the flange extending from the lower end of the syrup delivery conduit, with the interposition of a spring, which permits a displacement downwardly of said cover and of the cup-like device connected thereto so that the flexible water supply pipe can be swung downwardly so that the rod of the valve controlling the water supply can be moved in order to open said water valve so that water only is fed into said device, while the main valve remains in standstill condition and no syrup is dispensed.

3. In a metering-distributor according to claim 2, wherein the cover having a central cap at its peripheral edge partially extends downwardly in that portion thereof which faces the water supply pipe, while two vertical parallel lugs depend from the two sides of said cover, parallel to the axes of the distributor and of the water supply pipe in the rest position of this latter, each lug having a horizontal shoulder on its inner surface, which shoulders form in combination horizontal guiding rails to support said cup-like device, while from the outer surfaces of said lugs coaxial pins extend outwardly, a control forked arm, pivotally connected to a stationary wall supporting the distributor including longitudinally elongated slots designed to receive said pins, said control arm being designed to move said cup-like device up or down so as to selectively permit dispensing water-syrup mixture or only water, according to the direction of the vertical movement of said control arm.

4. Improvement according to claim 2, wherein the lower part of the cup-like device has laterally opposite outwardly projecting small limbs ending at their rear part with a tooth extending downwardly, said limbs being designed to be slidably mounted on said guiding rails formed by the shoulders arranged on said lugs, while said teeth constitute hooking means to releasably lock the two parts forming the cup-like device to one another in the operative condition of said device.

5. Improvements according to claim 2, wherein the frusto-conical upper part of the cup-like device has a central hole therein in an inclined plane so as to define a wall portion which extends downwardly in the front of the entrance of the pipe union which extends downwards, so as to constitute a baffle means to prevent water splashes from entering the upper chamber into which the syrup falls down from the syrup delivery conduit.

* * * * *